United States Patent [19]

Vice

[11] 4,111,505

[45] Sep. 5, 1978

[54] CHILD-PROOF CABINET

[76] Inventor: George A. Vice, 105C E. Crooked Hill Rd., Pearl River, N.Y. 10965

[21] Appl. No.: 768,339

[22] Filed: Feb. 14, 1977

Related U.S. Application Data

[63] Continuation-in-part of Ser. No. 661,369, Feb. 25, 1976, Pat. No. 4,008,934.

[51] Int. Cl.[2] ..... A47B 81/00; A47B 95/02

[52] U.S. Cl. ..... 312/209; 312/212; 312/244; 312/292

[58] Field of Search ..... 312/209, 211, 212, 213, 312/214, 244, 284, 290, 306

[56] References Cited

U.S. PATENT DOCUMENTS

| | | | |
|---|---|---|---|
| 2,190,498 | 2/1940 | Williams | 312/244 |
| 3,052,508 | 9/1962 | Fink | 312/214 |
| 3,110,533 | 11/1963 | Le Bron | 312/290 |
| 3,872,342 | 3/1975 | Dankert | 312/212 |
| 3,877,744 | 4/1975 | Miller | 312/284 |
| 3,922,048 | 11/1975 | Christianson et al. | 312/284 |

FOREIGN PATENT DOCUMENTS

| | | | |
|---|---|---|---|
| 345,892 | 4/1920 | Fed. Rep. of Germany | 312/307 |
| 69,758 | 11/1945 | Norway | 312/284 |
| 742,607 | 12/1955 | United Kingdom | 312/284 |
| 24,366 | 1/1905 | United Kingdom | 312/290 |

*Primary Examiner*—Mervin Stein
*Assistant Examiner*—Victor N. Sakran

[57] ABSTRACT

A cabinet employed in the kitchen, bathroom or the like, which comprises an upright enclosure having an access opening on an upper horizontal surface thereof, which access opening may be completely covered by means of a movable cover attached to said surface. Said cover is removed from covering said opening by movement in the general direction of a frontmost vertical wall of the cabinet, and is preferably recessed within said cabinet in parallel position adjacent said frontmost wall. The cabinet of the present invention is useful for the storage of dangerous household chemicals and the like and is designed to prevent the ready access of these materials to children.

28 Claims, 4 Drawing Figures

CHILD-PROOF CABINET

CROSS-REFERENCE TO RELATED APPLICATIONS

The present application is a continuation-in-part of copending United States Application, Ser. No. 661,369, filed Feb. 25, 1976, by the inventor herein, now U.S. Pat. No. 4,008,934.

BACKGROUND OF THE INVENTION

The present invention relates generally to cabinets useful in kitchens, bathrooms and laundry rooms and, more particularly, to those cabinets having a single door opening from the top.

The prior art teaches a wide variety of storage cavities with equally variant structures determined by the location of their use. Some cabinets employ their upper horizontal surface as a work surface and thus provide access to the cabinet through doors or the like provided in the front or side surfaces thereof. Cabinets such as those employed as house washing machines provide an access door located on the upper horizontal surface which is conventionally hinged at a point adjacent the rear portion thereof and which does open from the front wall and backward toward the rear wall of the cabinet. In all instances respecting the cabinets bearing the above design, it has been found that children can easily gain access to the interior thereof, with the frequent result that injury may be caused by involvement with the mechanism or other dangerous instruments located within the cabinet.

Various child-proof cabinet designs have been proposed to attempt to reduce the incidence of injury to children in the above manner. In this connection, my copending application, Ser. No. 661,369 proposed a cabinet having a design wherein access is gained by the opening of a door hingably secured to the topmost surface thereof by the placement of the hinge adjacent the frontmost vertical panel of the cabinet. Thus, it is required to reach over toward the rear of the cabinet to enable the grasping of the door by a handle provided thereon to pull the door up toward the front of the cabinet. This design effectively placed access to such a cabinet out of the reach of children, thereby restricting accessibility of dangerous and harmful instruments.

Accordingly, the present invention comprises a further development of the above referenced copending application.

SUMMARY OF THE INVENTION

In accordance with the present invention, a cabinet is disclosed which comprises an enclosure defining an interior cavity having a rearmost vertical wall, a surface disposed in a horizontal plane defining an opening therein, a frontmost wall adjacent said surface, a container having an open mouth at one end thereof, said container removably located within said cavity, a cover for said opening and means for removably fastening said cover to said surface, whereby said opening is exposed by the movement of said cover in the general direction of said frontmost wall and into coextensive, parallel planar position adjacent thereto.

The cabinet of the present invention has as one of its primary features the provision of a unique door or cover which, when brought into position out of obstruction of said opening may be totally recessed within the enclosure. The cover is suspended on a pair of tracks and may be slidably moved out of contact with said opening and into fully recessed position. The means of attachment of the cover to the surface defining the opening may vary to accommodate differences in the type of cover employed. Thus, the cover may be a unitary planar structure supported on the pair of tracks which have either stationary pegs or movable wheels located beneath said surface adjacent said opening.

In an alternate embodiment, the cover may be of a flexible or segmented nature which is then engaged at the lateral edges thereof within paired, opposed, generally L-shaped track members which facilitate its slidable movement out of position with respect to said surface and into recessed position adjacent said frontmost wall.

Accordingly, it is a principal object of the present invention to provide a cabinet enclosure capable of operation by adults only whereby access by children is minimized.

Another object of the present invention is to provide the cabinet as aforesaid which contains a storage liner promoting the easy removal of storage materials within said cabinet.

A further object of the present invention is to provide the cabinet as aforesaid which employs a cover requiring the ability of the user to reach the top-furthest surface thereof, which cover is attached for slidable operation into and out of contact with an opening in said cabinet providing access to the interior thereof.

It is a further object of the present invention to provide the cabinet of the aforesaid which employs a plastic liner of a design providing vent openings facilitating air circulation and minimizing waste.

Further objects and advantages of the present invention will become more apparent to those skilled in the art from a consideration of the description which follows with reference to the following detailed drawings.

DETAILED DESCRIPTION OF THE INVENTION

The present invention relates to a cabinet enclosure, either of unitary construction or of an integral part of the kitchen cabinet assembly. The cabinet includes four wall members, disposed at right angles with respect to each other which are supported by a recessed support stand. The rearmost wall member, adapted for placement against a wall of the room containing the cabinet, extends upwardly from the lateral, horizontal work surface atop the cabinet and is utilized as a splash board. The work surface includes a cover whose uppermost surface lies in a common plane with the work surface when in position thereagainst, and further includes a handle located within a recess defined within said cover adjacent a marginal edge in proximate location to said rearmost vertical wall. The cover is preferably of a generally rectangular shape defined by marginal edges, which, in one embodiment, taper inward and downwardly to provide a support for the cover upon similarly directed edges defined in said surface.

A plastic liner possessing a depth and width less than than defined in said horizontal surface is included in the cabinet cavity and rests on a floor thereof provided near the base of said enclosure. The liner has a plurality of openings in its walls, and further defines a pair of hand grasping openings located near the opened top portion thereof. The floor of the liner and a portion of the wall adjacent thereto are devoid of openings and may serve as a basin to retain accidentally spilled household chemicals therein.

DESCRIPTION OF THE PREFERRED EMBODIMENTS

Figure 1:
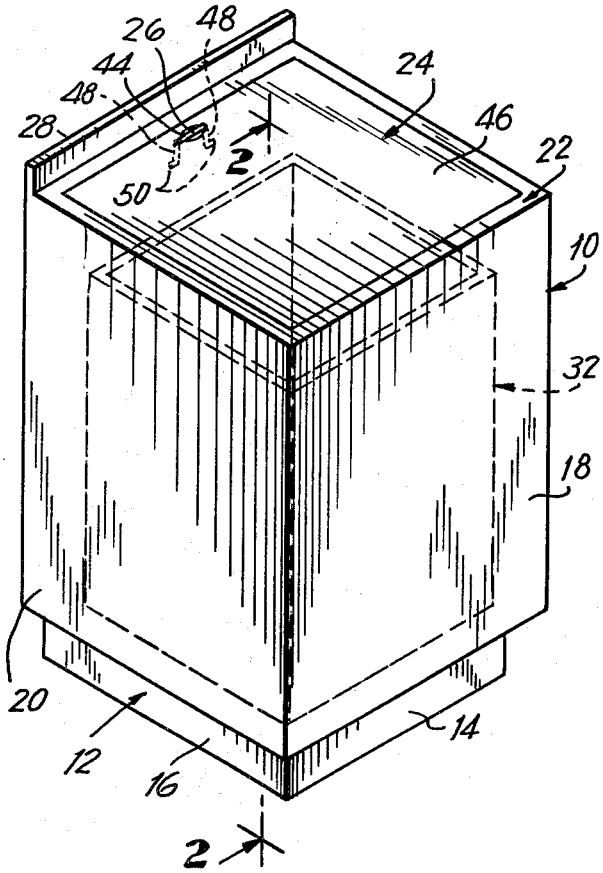
FIG. 1 is a perspective view partially in phantom illustrating the cabinet in accordance with the present invention.

Referring now to the drawings, and, more particularly, to the embodiment illustrated in FIG. 1, there is shown in perspective a rectangular cabinet 10 supported on a base 12. The frontmost surface 14 and the side surface 16 of the base are shown recessed inwardly from the frontmost wall 18 and the side wall 20, respectively, of the cabinet whereby a toe space is defined. The uppermost work surface 22, which is generally in the horizontal plane, has associated therewith a generally rectangular door panel or cover 24, which is adapted to be retained in flush, marginal contact with horizontal surface 22, in the manner illustrated in FIG. 1, when located in the closed position and which essentially completely closes the opening defined in surface 22. Cover 24 further comprises pull handle 26 which may lie atop cover 24, or may reside in a recessed position within an appropriately defined recess in cover 24. Additionally, splash panel 28 may be provided as an extension of rearmost vertical wall 30 in the manner better illustrated in FIG. 2, in the instance where cabinet 10 is situated in a working area such as a kitchen or laundry, adjacent a sink or the like. The container 32 shown in FIG. 1 in phantom, rests within the interior cavity of cabinet 10. The container 32 possesses a dimensional outline permitting convenient passage through the opening formed by surface 22 and is unobstructed by the movement of the cover 24 in the manner illustrated in phantom in the drawings.

The present invention has as its primary characterizing feature the provision of cover 24 in slidable association with surface 22, as it is adapted to thereby move in the general direction of frontmost wall 18 and to recede into coextensive, parallel planar position within the interior cavity upon conclusion of its removal from covering the opening defined by surface 22.

Referring again to FIG. 2, cover 24 is shown in solid lines in this side sectional view as resting within surface 22. In this embodiment, cover 24 is provided on the under surface thereof with parallel track members 34, illustrated more clearly in FIG. 3. surface 22, as it is adapted to thereby move in the general direction of frontmost wall 18 and to recede into coextensive, parallel planar position within the interior cavity upon conclusion of its removal from covering the opening defined by surface 22.

Figure 2:
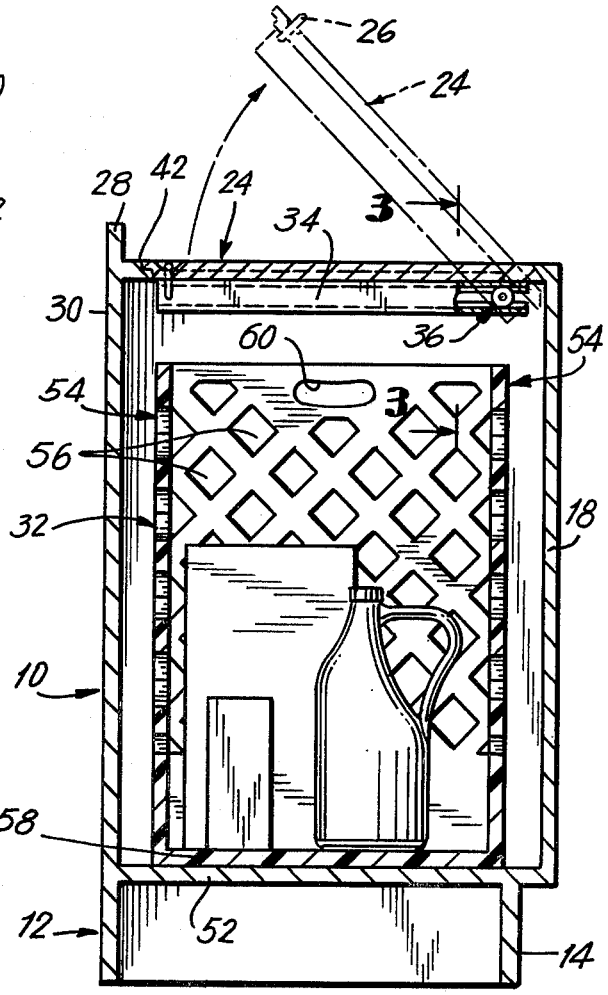
FIG. 2 is a side sectional view partially in phantom taken on line 2—2 of FIG. 1.
Figure 4:
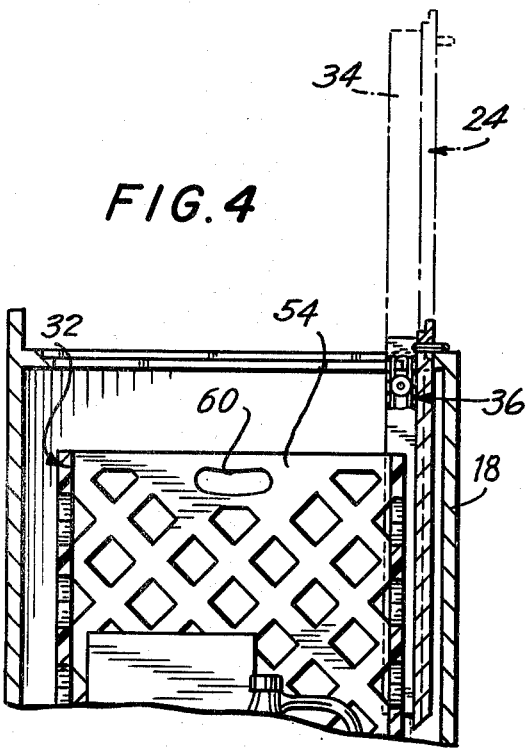
FIG. 4 is a broken side sectional view partially in phantom illustrating further the operation of the cover in accordance with an embodiment of the present invention.
Figure 3:
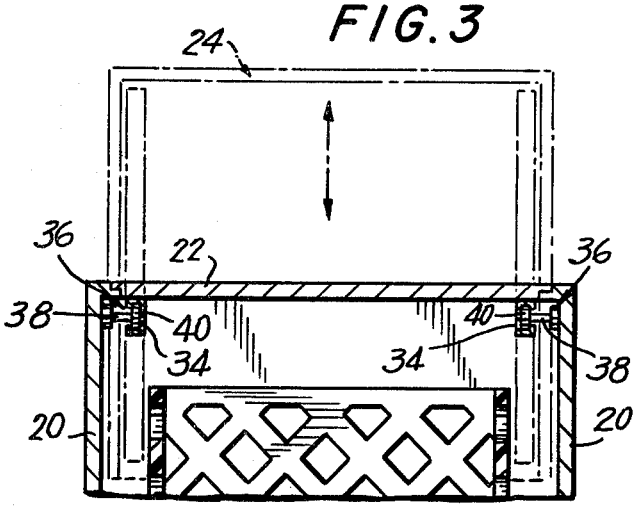
FIG. 3 is a broken frontal sectional view partially in phantom taken on line 3—3 of FIG. 2 further illustrating the operation of the cover in accordance with the present invention.

Referring again to FIG. 2, cover 24 is shown in solid lines in this side sectional view as resting within surface 22. Track members 34 are located and mounted in parallel relationship to the plane which defines the general direction of movement of cover 24 with respect to surface 22. That is, as illustrated in FIGS. 2, 3 and 4, in phantom, cover 24 moves generally in the direction of an arc having a general direction toward the frontmost wall 18. Upon its movement into an essentially vertical position, as illustrated in phantom, in FIG. 4, cover 24 may be moved downwardly into recessed position in parallel relationship to frontmost wall 18. As this movement is conducted through a plane substantially perpendicular to that containing frontmost wall 18, the positioning of track members 34 is thus understood to reside likewise in a position perpendicular to frontmost wall 18 thereby facilitating the movement of cover 24 with respect thereto.

Track members 34 are disposed in slidable engagement with respect to the axis or points 36 achieving a pivoting relationship with respect to surface 22 of cover 24. Specifically, points 36 may comprise essentially cylindrical structures having a circular cross-section which extends in a plane parallel to that containing frontmost wall 18 and closely adjacent thereto. Thus, as can be seen more clearly in FIG. 3, points 36 may comprise cylindrical rod-like extensions, such as described above or as illustrated herein, or may comprise axles 38 upon which wheels 40 may be mounted for rollable engagement with track members 34. In this manner, points 36 provide a point of pivotal movement of the cover 24 which permits it to operate in the manner of a conventionally hinged door until it enters a vertical plane parallel with that of frontmost wall 18, at which point it may move downwardly into recessed position with respect to wall 18. In this manner, the chief advantages of the present invention reside in the general inaccessability of the cover 24 to the child together with the relative freedom of movement provided by the recessiblity of the cover upon opening.

While the foregoing discussion has dealt primarily with the embodiments illustrated in FIGS. 2, 3 and 4, it is to be understood that the concepts outlined above have general applicability in variant forms to achieve the same results.

Specifically, although not illustrated herein, the cover of the present invention might comprise a flexible structure either unitary or segmented in nature which is mounted with its lateral edges located within track members similar in configuration to track members 34. These track members would be fastened to the underside of surface 22 and would run in a similarly parallel direction. These track members would additionally possess a generally L-shaped configuration, as they would extend downwardly in parallel relationship to frontmost wall 18. Thus, access to the opening in surface 22 would be achieved by pulling in the direction of frontmost wall 18 upon an appropriate handle fastened to the cover whereby the cover would then slide through the track in the direction of frontmost wall 18 and thence down through the track into parallel conformity therewith, and thus, into the same position illustrated with respect to cover 24 in FIG. 4.

A further modification to the foregoing embodiment would comprise the provision on the underside of the flexible cover of a series of connecting points, wheels or a continuous flexible track which would appropriately mate with the track members attached to surface 22, to enable the cover to reside in flush relationship to the lateral marginal edges of surface 22. The above description is meant to be illustrative and not restrictive, as the present invention is capable of a wide variety of modifications which lie within the scope of the present invention.

Returning to the drawings, and, in particular to FIG. 2, it can be seen that cover 24 in its position resting in registry with surface 22 is provided at the marginal edges thereof with downwardly converging, stepped surface indentation 42 which mates with a similar configuration residing on the marginal edges surrounding the opening in surface 22. Thus, when at rest, cover 24 is prevented from falling below flush engagement with surface 22, and the adult user is thus provided with a continuous working surface.

In addition, and as indicated above, handle 26 may be collapsible into a recess thus preventing obstruction of the continuous surface provided by cover 24 and surface 22. Referring again to FIG. 1, handle 26 may reside when not in use within recess 44 whereby it is out of the way and flush with respect to outer lateral surface 46 of cover 24. Handle 26 may possess a structure having a vertical U-shaped cross-section comprising a central U-bend and a pair of legs 48. Legs 48 are adapted, at their distal ends, to define outwardly directed wing structures 50. Thus, when pulling force is exerted on handle 26, wings 50 are brought into abutment with the underside or undersurface of cover 24 and handle 26 is retained in integral connection therewith. Legs 48 pass through parallel holes in cover 24 such that, when handle 26 is at rest, legs 48 pass through said holes permitting handle 26 to sink into recess 44.

In all other respects, cabinet 10 is similar to the cabinet disclosed in my copending application referenced above, disclosure of which is incorporated herein by reference. Thus, referring to the drawings and particularly to FIG. 2, the interior container 32 is shown resting on horizontal surface 52 in the interior of cabinet 10. Container 32 thus comprises a substantially rectangular structure having an open surface at one end thereof defined by four mating wall surfaces 54 defining at their upper extremities a plurality of perforations 56 which permit ventilation of container 32 to take place. At the lower extremity of the container 32, wall surfaces 54 are unperforated and continue thusly into integral contact with floor portion 58. Thus, the absence of perforations provides a catch basin for any of the chemicals, detergents or the like, now shown, and which might inadvertently spill within the container 32. At the upper extremity of opposed wall surfaces 54, elongated cut-outs defining hand grips 60, as shown in FIGS. 2 and 4, are provided to facilitate removal of container 32 from the interior cavity of cabinet 10.

While we have shown a singular depicted embodiment whereby the cover is moved from the rearmost wall to the frontmost wall, it will be apparent to those skilled in the art that the same has been done for the purpose of limiting the number of drawings which must be depicted in the present invention. However, it is to be understood that the terms rearmost and frontmost, as herein used, is specifically intended for the purpose of comprehension of the invention when considered in conjunction with FIGS. 1 through 4 of the drawings. Therefore, it is within the contemplation of the present invention to geometrically and physically reorient the features of the combination whereby the movement of the door can be by the frontmost wall to the rearmost wall, or stated alternatively, from a first vertical wall towards a second diametrically opposed vertical wall. In this regard, it will also be apparent that the movement of a door may be from one side of the cabinet to the other side of the cabinet. In all instances, the cabinet, when in the closed position, will provide an upper planar surface for utilization as a work space, with the cover thereof being highly inaccessible to young children and capable of recessed disposition, as was discussed in detail hereinbefore when it is desired to obtain entry to the interior recessed portion of the cabinet.

While the preferred embodiments of the present invention have been shown and described herein, it will be apparent to those skilled in the art that there are many modifications, changes and improvements which may be made herein without departing from the spirit and scope of the invention as herein disclosed and claimed.

What is claimed is:

1. A cabinet comprising an enclosure defining an interior cavity, said enclosure comprising a rearmost vertical wall, a substantially horizontal surface having an opening defined therein for access to said cavity, a substantially integrally formed frontmost wall adjacent to said surface, a container having an open mouth at one end thereof, said container being removably disposed within said cavity, a cover for said opening and means for movably fastening said cover to said surface for effectively covering and uncovering said opening, said last mentioned means including means for exposing said opening by the movement of said cover in the general direction of said frontmost wall and into coextensively disposed parallel planar position adjacent thereto and said opening being covered by the movement of said cover in the general direction away from said frontmost wall and toward said rearmost vertical wall.

2. A cabinet in accordance with claim 1, wherein said movable fastening means comprises a pair of parallel track members slidably associating said cover with said opening.

3. A cabinet in accordance with claim 2, wherein said track members are mounted in parallel relationship to the plane defining said general direction of movement of said cover with respect to said surface.

4. A cabinet in accordance with claim 2, wherein said track members are mounted on the broad surface of said cover faces said cavity and covers said opening.

5. A cabinet in accordance with claim 2, wherein said surface includes a plurality of marginal edges defining said opening, and said track members are mounted on said surface and lie within said cavity in adjacent relation to said marginal edges.

6. A cabinet in accordance with claim 5, wherein said track members are of generally L-shaped configuration and extend in parallel relationship along said marginal edges and thence in a downward direction parallel to and adjacent said frontmost wall.

7. A cabinet in accordance with claim 6, wherein said track slidably communicate with said cover at the lateral edges thereof.

8. A cabinet in accordance with claim 7, wherein said cover possesses a longitudinally segmented hinged structure.

9. A cabinet in accordance with claim 8, wherein said cover comprises an integral planar structure capable of pivotal movement through an arc of 90°.

10. A cabinet in accordance with claim 4, wherein said track members slidingly communicate with said opening in parallel disposed juxtaposed points lying adjacent and along opposing marginal edges.

11. A cabinet in accordance with claim 10, wherein said points lie along said marginal edges contained in planes parallel to the plane defining said general direction of movement of said cover with respect to said surfaces.

12. A cabinet in accordance with claim 11, wherein said points are defined by members having essentially circular cross-sections and situated with their axes perpendicular to the plane defining said general direction of movement.

13. A cabinet in accordance with claim 12, wherein said points comprise stationary cylindrical rods mounted adjacent said marginal edges and disposed within said cavity.

14. A cabinet in accordance with claim 12, wherein said members defining said points are adapted for rollable contact with said track members.

15. A cabinet in accordance with claim 14, wherein said points comprise freely rotational wheels mounted upon axles, and said wheels being disposed within said track members for rotation therewithin.

16. A cabinet in accordance with claim 1, comprising a pair of side walls lying in spaced apart relationship adjacent said rearmost and said frontmost walls.

17. A cabinet in accordance with claim 16, wherein said surface is bounded by said rearmost side and frontmost walls.

18. A cabinet in accordance with claim 1, comprising a plate extending upwardly from said surface, and said plate being disposed in adjacent relationship to said rearmost vertical wall.

19. A cabinet in accordance with claim 1, including a handle disposed upon said cover adjacent a marginal edge thereof, and said handle manually manipulating said cover into and out of contact with said opening.

20. A cabinet in accordance with claim 1, wherein said cover includes an outer lateral surface, said lateral surface being disposed in the horizontal plane when said cover is located in contact with said opening.

21. A cabinet in accordance with claim 20, wherein said handle is positioned below said lateral surface.

22. A cabinet in accordance with claim 21, wherein said handle is located within a recess formed in said lateral surface and comprises a structure having a vertical U-shaped cross-section defining a U-bend and a pair of legs, said recess having a pair of holes, said handle being secured within said recess by the passage of said legs through said holes, said handle being adapted for securement to said lateral surface by the provision of oppositely directed wing structures on said legs, said wing structures being distal to said U-bend, and said wing structures being adapted to engage said cover on the surface disposed opposite said outermost lateral surface.

23. A cabinet in accordance with claim 1, including a supporting base located beneath said enclosure, said supporting base having a frontmost vertical wall disposed intermediate said rearmost vertical wall and said frontmost wall of said enclosure, and a pair of vertical side walls disposed in spaced apart relationship and recessed inwardly with respect to said side walls of said enclosure.

24. A cabinet comprising an enclosure defining an interior cavity, said enclosure comprising a first vertical wall, a substantially horizontal surface having an opening defined therein for access to said cavity, a second vertical wall in diametric opposite relationship to said first wall disposed adjacent to said surface, a container having an open mouth at one end thereof, said container being removably disposed within said cavity, a cover for said opening and means for movably fastening said cover to said surface, said last mentioned means including means for exposing said opening by the movement of said cover in the general direction of said second wall and into coextensively disposed parallel, planar position adjacent thereto.

25. A cabinet in accordance with claim 24, wherein said movable fastening means comprises a pair of parallel track members slidably associating said cover with said opening.

26. A cabinet in accordance with claim 25, wherein said track members are mounted in parallel relationship to the plane defining said general direction of movement of said cover with respect to said surface.

27. A cabinet in accordance with claim 25, wherein said track members are mounted on the broad surface of said cover facing said cavity and covering said opening.

28. A cabinet in accordance with claim 25, wherein said surface includes a plurality of marginal edges defining said opening, and said track members being mounted on said surface and lying within said cavity in adjacent relationship to said marginal edges.

* * * * *